US006518708B2

(12) United States Patent
Aso

(10) Patent No.: US 6,518,708 B2
(45) Date of Patent: Feb. 11, 2003

(54) DATA SIGNAL LINE DRIVING CIRCUIT AND IMAGE DISPLAY DEVICE INCLUDING THE SAME

(75) Inventor: Yuji Aso, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/977,815

(22) Filed: Oct. 15, 2001

(65) Prior Publication Data

US 2002/0074948 A1 Jun. 20, 2002

(30) Foreign Application Priority Data

Oct. 19, 2000 (JP) ..... 2000-319871

(51) Int. Cl.[7] ..... G09G 3/10
(52) U.S. Cl. ..... 315/169.1; 315/169.3
(58) Field of Search ..... 315/169.1, 169.2, 315/169.3, 169.4, 172; 313/500, 505, 506; G09G 3/10

(56) References Cited

U.S. PATENT DOCUMENTS 6,229,505 B1 * 5/2001 Fujii ..... 313/504
6,310,616 B1 * 10/2001 Yanagi et al. ..... 345/204
6,392,354 B1 * 5/2002 Matsueda ..... 315/169.1
6,404,135 B1 * 6/2002 Shino ..... 313/309

FOREIGN PATENT DOCUMENTS

| | | | |
|---|---|---|---|
| JP | 07-219484 | 8/1995 | ..... G09G/3/36 |
| JP | 08-137443 | 5/1996 | ..... G09G/3/36 |
| JP | 08-234237 | 9/1996 | ..... G02F/1/136 |
| JP | 09-026765 | 1/1997 | ..... G09G/3/36 |
| JP | 09-281930 | 10/1997 | ..... G09G/3/36 |
| JP | 10-319424 | 12/1998 | ..... G02F/1/1345 |
| JP | 10-319429 | 12/1998 | ..... G02F/1/136 |
| JP | 11-073164 | 3/1999 | ..... G09G/3/36 |
| JP | 11-249629 | 9/1999 | ..... G09G/3/36 |
| JP | 010075 | 1/2000 | ..... G02F/1/133 |
| JP | 010526 | 1/2000 | ..... G09G/3/36 |

OTHER PUBLICATIONS

*"An LCD Addressed by a–Si:H TFTs With Peripheral poly–Si TFT Circuits"*, T. Tanaka et al., Hitachi Research Laboratory, pp. 389–392, (1993).

* cited by examiner

*Primary Examiner*—Don Wong
*Assistant Examiner*—Trinh Vo Dinh
(74) *Attorney, Agent, or Firm*—David G. Conlin; Steven M. Jensen; Edwards & Angell, LLP

(57) ABSTRACT

A data signal line driving circuit is provided with a unit block which corresponds to each set of data signal lines corresponding to the data signal lines for two pixels adjacently provided in the direction of a scanning signal line. Each unit block is provided with a positive polarity system including a level shifter, a D/A converter and a voltage follower for the positive polarity, and a negative polarity system including a level shifter, a D/A converter and a voltage follower for the negative polarity. Further, the ranges of power voltages of the positive polarity voltage follower and the negative polarity voltage follower are respectively the high voltage side half and the low voltage side half of the range of a power voltage of a positive/negative polarity-compatible voltage follower. Further, each unit block is provided with a selector and a switch which distribute digital video signals to the two systems, and an analog switch which distributes respective output of the two voltage followers to the corresponding pixels, thereby providing a data signal line driving circuit capable of low power consumption while having the voltage followers.

6 Claims, 4 Drawing Sheets

DATA SIGNAL LINE DRIVING CIRCUIT AND IMAGE DISPLAY DEVICE INCLUDING THE SAME

FIELD OF THE INVENTION

The present invention relates to a data signal line driving circuit of a digital matrix image display device using a digital image signal as an input signal, and an image display device including the same.

BACKGROUND OF THE INVENTION

It is conventionally common that AC driving is performed in a matrix image display device using scanning and data signal lines, such as an active-matrix liquid crystal display device. Among this kind of image display devices, the majority of digital image display devices using a digital image signal as an input signal, in order to perform AC driving, include a voltage follower compatible with both positive and negative polarities at a stage immediately after a D/A converter with respect to each data signal line in a data signal line driving circuit. However, in the case of using the voltage follower (an output amplifier) in that manner, the D/A converter should inevitably make itself compatible with both voltage ranges of the positive and negative polarities, that increases circuit scale. Given this, such an arrangement is disclosed in Japanese Unexamined Patent Publication No. 26765/1997 (Tokukaihei 9-26765 published on Jan. 28, 1997) that a processor having a positive polarity output amplifier and a processor having a negative polarity output amplifier are provided to two adjacent data signal lines, respectively, an input source to each processor and a destination of output from each processor are switched so that the data signal lines have different polarities. Further, the same arrangement is disclosed in Japanese Unexamined Patent Publication No. 10075/2000 (Tokukai 2000-10075 published on Jan. 14, 2000) and Japanese Unexamined Patent Publication No. 281930/1997 (Tokukaihei 9-281930 published on Oct. 31, 1997).

Further, Japanese Unexamined Patent Publication No. 73164/1999 (Tokukaihei 11-73164 published on Mar. 16, 1999) discloses an arrangement such that on upper and lower sides of a liquid crystal panel are respectively provided data signal line driving circuits with output buffers, one of which is used for the positive polarity and the other for the negative polarity, and connection can be switched so that, when either one of the data signal line driving circuits drives the odd-numbered data signal lines, the other drives the even-numbered data signal lines. Further, Japanese Unexamined Patent Publication No. 137443/1996 (Tokukaihei 8-137443 published on May 31, 1996) discloses an arrangement in which on upper and lower sides of a pixel array are respectively provided data signal line driving circuits, each including a positive polarity amplifier and a negative polarity amplifier, one of which drives the odd-numbered data signal lines and the other drives the even-numbered data signal lines so that they have different polarities and that the polarity reverses by field.

An image display device for a battery-driven device, the representative of which is a latest mobile information terminal, is required to reduce power consumption so that long-hour use can be attained. However, the foregoing data signal line driving circuit having the voltage followers has a problem that the large sum of bias currents increases power consumption.

In addition, the presence of numbers of digital image signal processors with voltage followers inevitably increases the circuit scale of the data signal line driving circuit, that raises another problem of being incompatible with high-resolution image display devices.

SUMMARY OF THE INVENTION

It is an object of the present invention to provide a data signal line driving circuit capable of low power consumption while having voltage followers, and an image display device including the same. Another object of the present invention is to provide a data signal line driving circuit capable of attaining a high-resolution image display device in addition to the first object, and an image display device including the same.

In order to attain the foregoing object, a data signal line driving circuit according to the present invention, which outputs an analog video signal to each of data signal lines of an image display device having scanning signal lines and the data signal lines via a voltage follower according to such a polarity relation that a polarity of a voltage with respect to a predetermined voltage of the adjacent data signal lines is reversed while reversing the polarity of the voltage of the single data signal line by a predetermined period, the analog video signal being obtained from an inputted digital video signal through D/A conversion, the data signal line driving circuit includes: a positive polarity system including a positive polarity D/A converter and a positive polarity voltage follower in the case of the polarity of the voltage, and a negative polarity system including a negative polarity D/A converter and a negative polarity voltage follower; selection circuits; and a switch circuit, wherein: both the positive polarity system and the negative polarity system are provided with respect to each set of the data signal lines consisting of a predetermined number of the consecutive data signal lines which are not less than three data signal lines, a range of a power voltage of the positive polarity voltage follower is a high voltage side half of a range of a power voltage of a positive/negative polarity-compatible voltage follower, and a range of a power voltage of the negative polarity voltage follower is a low voltage side half of the range of the power voltage of the positive/negative polarity-compatible voltage follower, the selection circuits each divide and selectively input the each digital video signal to the positive polarity system or negative polarity system in one scanning period so as to satisfy the polarity relation, and the switch circuit switches paths so that respective output signals of the voltage followers are outputted in parallel in order of the corresponding data signal lines.

With this arrangement, both the positive and negative polarity systems are provided with respect to each set of a predetermined number of the consecutive data signal lines which are not less than three data signal lines, and the selection circuits successively selectively input a plurality of digital video signals to be inputted for one set with respect to the respective systems in one scanning period, and the switch circuit outputs output signals of the respective voltage followers in parallel in order of the corresponding data signal lines. Furthermore, the voltage followers are separately provided for positive polarity use and for negative polarity use, and the ranges of power voltages thereof are respectively the high voltage side half and the low voltage side half of the range of a power voltage of a positive/negative polarity-compatible voltage follower.

This arrangement enables processing of all the digital video signals for input while allowing the voltage followers to be provided so that the total number of the voltage followers for a set of data signal lines is smaller than the total number of the set of data signal lines. Therefore, compared with the case where all data signal lines are provided with the voltage followers, the total number of the voltage followers is reduced while suppressing bias currents of the respective voltage followers. Accordingly, the sum total of bias currents of the voltage followers becomes small.

As discussed, it is possible to provide the data signal line driving circuit capable of low power consumption while having the voltage followers.

Further, since the number of systems which performs processing of the digital video signals to be inputted is decreased, it is possible to drive an image display device having a data signal line of a smaller pitch, thereby attaining a high-resolution image display device as well.

In addition to the foregoing arrangement, it is preferable that both the positive and negative polarity systems are provided with respect to each set of a predetermined even number of the consecutive data signal lines.

With this arrangement, since one set of the data signal lines consists of a predetermined even number of the data signal lines which are not less than four data signal lines, the positive and negative polarity systems can be used simultaneously. Consequently, when either one of the systems is in use, the other is free from standby power consumption, thereby greatly reducing power consumption.

Further, in addition to the foregoing arrangement, it is preferable that both the positive and negative polarity systems are provided with respect to each set of the data signal lines consisting of the data signal lines for two pixels, where one pixel is made up of three subpixels R, G and B which are adjacently disposed in a direction of the scanning signal line.

With this arrangement, since both the positive and negative polarity systems are provided with respect to each set of the data signal lines consisting of the data signal lines for two pixels, the operation of selective to input by the selection circuits and the operation of switch by the switch circuit can readily be performed in the color of R, G or B. Moreover, it is possible to attain a data signal line driving circuit with the enhanced general versatility which can be mounted in a common color image display device.

Further, in addition to the foregoing arrangement, it is preferable to include either one of the data signal line driving circuits and demultiplexers which switch connection paths between an output terminal of the switch circuit and the data signal line so that an output signal of the data signal line driving circuit is outputted to the corresponding data signal line.

With this arrangement, an image is displayed by thus outputting the output signal of the data signal line driving circuit to the corresponding data signal line by the demultiplexers. Therefore, in the case where analog video signals are chronologically divided and outputted from the switch circuit in one scanning period, the analog video signals can be distributed to the corresponding data signal lines with ease, while making it possible to provide an image display device capable of low power consumption.

Additional objects, features, and strengths of the present invention will be made clear by the description below. Further, the advantages of the present invention will be evident from the following explanation in reference to the drawings.

DESCRIPTION OF THE EMBODIMENTS

The following will explain one embodiment of a data signal line driving circuit and an image display device including the same according to the present invention with reference to FIGS. 1 to 4.

Figure 3:
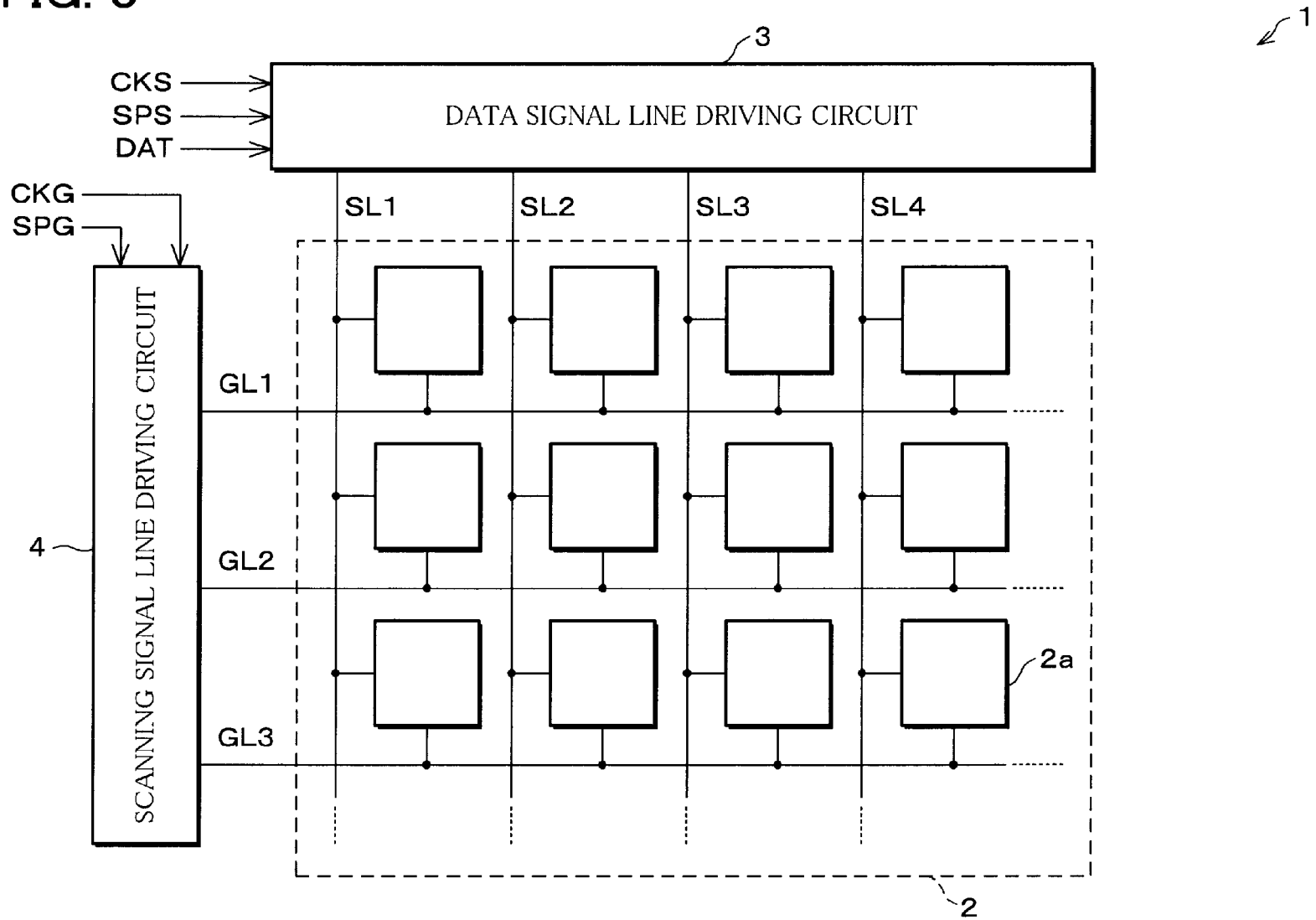
FIG. 3 is a block diagram showing an arrangement of an image display device including the data signal line driving circuit of FIG. 1.

FIG. 3 shows a configuration of a liquid crystal display device 1 as an example of the image display device. The liquid crystal display device 1 is a active-matrix digital liquid crystal display deice using a TFT (Thin Film Transistor) as a switching element of a pixel. The liquid crystal display device 1 includes a pixel array 2, a data signal line driving circuit 3, and a scanning signal line driving circuit 4. In addition, to the pixel array 2 are connected numerous data signal lines SLi (i=1, 2, . . . , n) and numerous scanning signal lines GLj (j=1, 2, . . . , n) intersecting with one another. In a portion enclosed by the two adjacent data signal lines SLi and SLi+1 and the two adjacent scanning signal lines GLj and GLj+1 is provided a pixel 2*a*, and a plurality of the pixels 2*a* as a whole are disposed in a matrix.

As shown in FIG. 3, the data signal line driving circuit 3 receives a clock signal CKS, a start signal SPS and a digital video signal DAT inputted from the outside. The data signal line driving circuit 3 have such a function as to store the digital video signal DAT of one horizontal scanning period upon input thereof, and convert the digital data thus stored to an analog video signal in a D/A converter which will be discussed below, and write the analog video signal to each data signal line SLi via a voltage follower which will be discussed below. Further, the scanning signal line driving circuit 4 receives a clock signal CKG and a start signal SPG inputted from the outside. The scanning signal line driving circuit 4 has such a function as to successively select a scanning signal line GLj in synchronism with a timing signal, such as the clock signal CKG, and control the opening and closing of a switching element which is provided within each pixel 2*a*, thereby writing an analog video signal written in each data signal line SLi in turn into each pixel 2*a* and making each pixel 2*a* hold the analog video signal.

Figure 4:
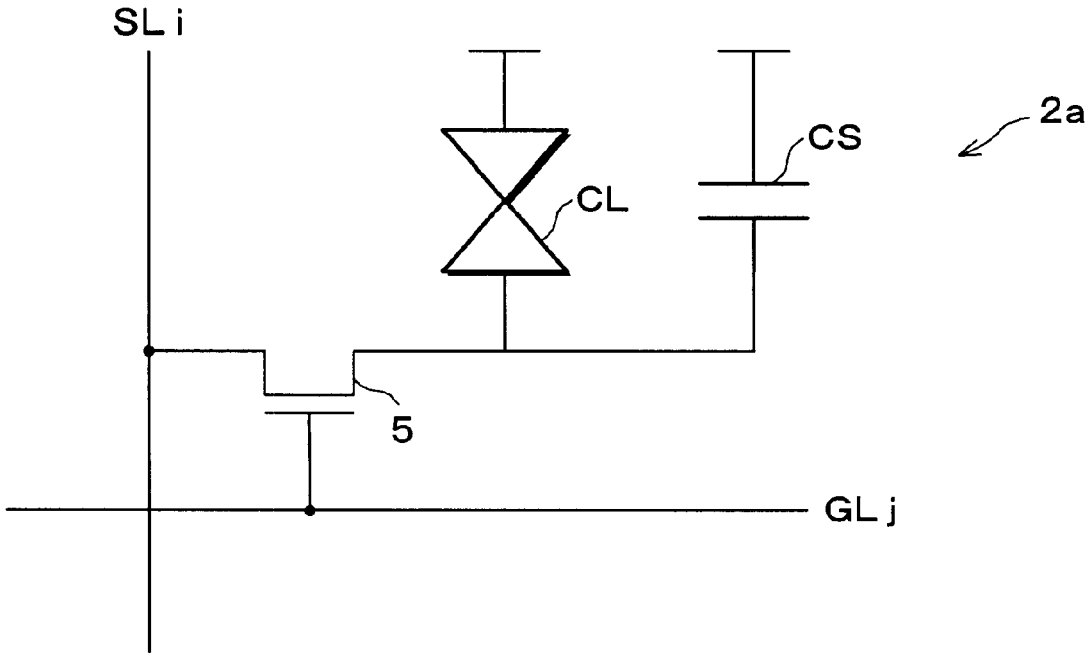
FIG. 4 is a circuit diagram showing an electrical arrangement of pixels in the image display device of FIG. 3.

FIG. 4 shows an arrangement of the pixel 2*a*. Each pixel 2*a* has an electric field-effect transistor (TFT in particular) 5 as the switching element and a pixel capacitance. The pixel capacitance is made up of a liquid crystal capacitance CL and an auxiliary capacitance CS to be added as required. In FIG. 4, one electrode (pixel electrode) of the pixel capacitance is connected to the data signal line SLi via a drain and a source of the electric field-effect transistor 5. In addition, the gate of the electric field-effect transistor 5 is connected to the scanning signal line GLj, and the other electrode of the pixel capacitance is connected to a common electrode line which is common among all the pixels 2*a*. By thus arranging the pixel 2*a*, the electric field-effect transistor 5 is brought into conduction by applying a selection voltage to the gate of the electric field-effect transistor 5, and a voltage of each liquid crystal capacitance CL is changed via the data signal line SLi, thereby modulating transmissivity or reflectance of a liquid crystal and displaying an image.

Next, the following will describe the data signal line driving circuit 3. Generally, the liquid crystal display device needs to perform AC driving whereby a voltage to be applied to the liquid crystal is reversed (the polarity is reversed) by field. Modes of such reversal include a line reversal mode to reverse at a timing of every horizontal scanning period, a source reversal mode to reverse by each adjacent data signal line (source bus-line), and a dot reversal mode to reverse all adjacent pixels (dots) on the right and left, and upper and lower sides. In the present embodiment will be explained the case of the source reversal mode whereby the effect of reducing power consumption is largest.

In the case of the source reversal mode, the polarity of a voltage of a pixel to be connected to a single data signal line SLi is the same with respect to the voltage of the common electrode line. Consequently., in the case of an ordinary video signal whereby the bulk of display remains alike, the value of a potential of the data signal line SLi is substantially the same as that of a data signal line SLi immediately before. Therefore, only a small quantity of charge should be added from the data signal line driving circuit 3, thereby greatly reducing power consumption in writing a video signal into the liquid crystal compared to the line or dot reversal mode.

Figure 1:
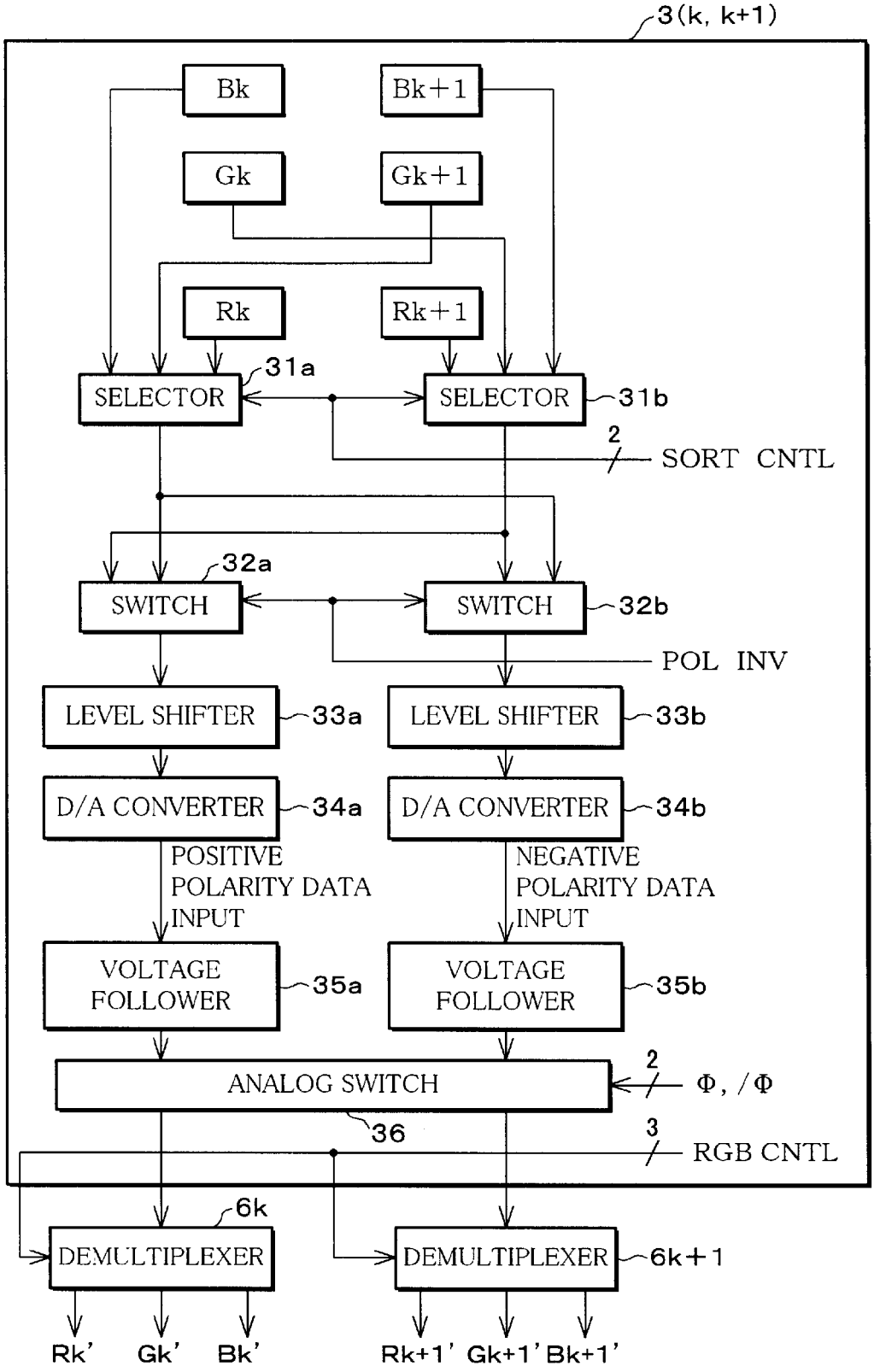
FIG. 1 is a block diagram showing an arrangement of a data signal line driving circuit according to one embodiment of the present invention.

FIG. 1 shows an arrangement of a unit block 3(k,k+1) which makes up the data signal line driving circuit 3. Here, in the pixel array 2, it is assumed that each of the pixels 2*a* of R, G and B adjacent in a direction of the scanning signal line GLj is a subpixel, and one pixel is composed of three subpixels. The unit block 3(k,k+1) is provided to each set of six data signal lines SLi to be connected to a pixel k (odd-numbered) and a pixel k+1 (even-numbered), when counted from one side of the pixel array 2 in the direction of the scanning signal line GLj, for example, from the left side in FIG. 3. In the case of VGA, 320 unit blocks 3(k,k+1) are provided in the data signal line driving circuit 3. In the case of SVGA, 400 unit blocks 3(k,k+1) are provided in the data signal line driving circuit 3. In addition, a plurality of the unit blocks 3(k,k+1) can be packaged together as an IC.

The unit block 3(k,k+1) is made up of selectors 31*a* and 31*b*, switches 32*a* and 32*b*, level shifters 33*a* and 33*b*, D/A converters 34*a* and 34*b*, voltage followers 35*a* and 35*b*, and an analog switch 36. Among these, the level shifter 33*a*, the D/A converter 34*a* and the voltage follower 35*a* are video signal processors for the positive polarity only, thereby forming a positive polarity system. The level shifter 33*b*, the D/A converter 34*b*, and the voltage follower 35*b* are video signal processors for the negative polarity only, thereby forming a negative polarity system. Further, on the preceding stages of the selectors 31*a* and 31*b* are provided latch circuits and a hold memory which are not shown, thereby holding digital video signals Rk, Gk and Bk of the pixel K and digital video signals Rk+1, Gk+1 and Bk+1 of the pixel k+1, that are given from an external control circuit.

The selectors 31*a* and 31*b* and the switches 32*a* and 32*b* select a predetermined signal from the group of the digital video signals Rk, Gk, Bk, Rk+1, Gk+1 and Bk+1 according to the display sequence and the polarity, thereby inputting the selected predetermined signals to the positive and negative polarity systems. A polarity relation is set so as to reverse the polarities of voltages of the adjacent data signal lines SLi and SLi+1 with respect to a voltage (predetermined voltage) of the common electrode line, while reversing the polarity of the voltage of the single data signal line SLi by a predetermined period. For example, in the case where a treatment of the positive polarity is applied to the digital video signals Rk, Bk and Gk+1 while applying a treatment of the negative polarity to the digital video signals Gk, Rk+1 and Bk+1 in a certain horizontal scanning period (1 scanning period), then the selectors 31*a* and 31*b* respectively select the digital video signals Rk and Rk+1 based on a 2-bit sort control signal SORT CNTL shown in FIG. 1 in the first one third of the horizontal scanning period. In addition, based on a polarity inversion signal POL INV, the switch 32*a* connects an output terminal of the selector 31*a* and an input terminal of the level shifter 33*a*, and the switch 32*b* connects an output terminal of the selector 31*b* and an input terminal of the level shifter 33*b*.

In the second one third of the horizontal scanning period, the operation of the switches 32*a* and 32*b* remains unchanged, and the selectors 31*a* and 31*b* respectively select the digital video signals Gk+1 and Gk. Further, in the last one third of the horizontal scanning period., the operation of the switches 32*a* and 32*b* remains unchanged, and the selectors 31*a* and 31*b* respectively select the digital video signals Bk and Bk+1. The polarity is reversed, for example, by field in a predetermined period. At the time of such reversal, the polarity inversion signal POL INV is switched, thereby causing the switch 32*a* to connect the output terminal of the selector 31*b* and the input terminal of the level shifter 33*a*, and the switch 32*b* to connect the output terminal of the selector 31*a* and the input terminal of the level shifter 33*b*. Thus, the selector 31*a* and 31*b* and the switches 32*a* and 32*b* function as selection circuits which selectively input each of the inputted digital video signals to the positive or negative polarity system so as to satisfy the foregoing polarity relation.

With respect to the digital video signals thus inputted to the positive or negative polarity system, the level shifters 33*a* and 33*b* perform the conversion of a voltage level, and the D/A converters 34*a* and 34*b* convert them to analog video signals. Thereafter, the analog video signals are respectively inputted as positive or negative polarity data to the voltage followers 35*a* and 35*b*.

Figure 2:
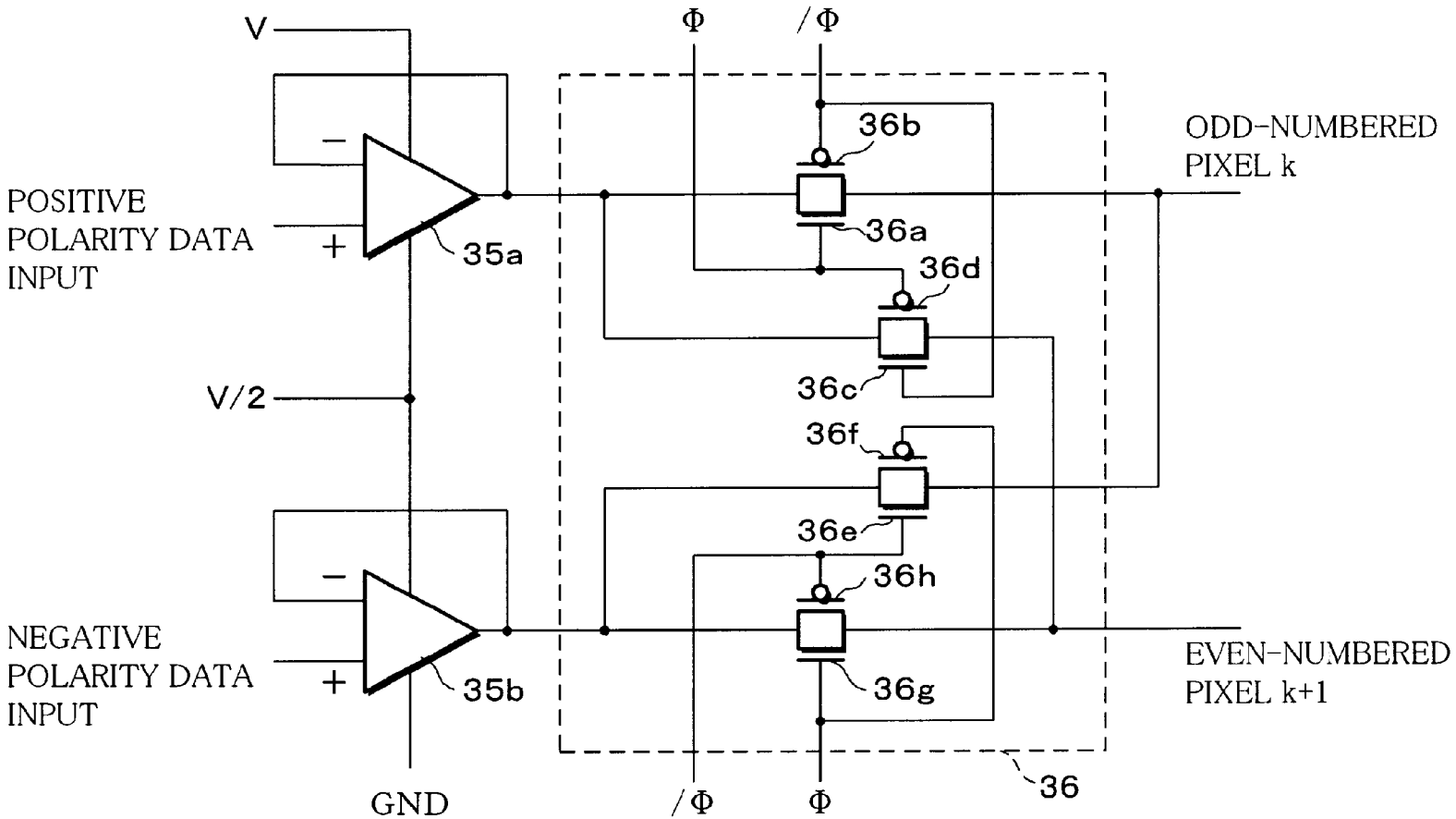
FIG. 2 is a circuit block diagram showing a partial arrangement of the data signal line driving circuit of FIG. 1.

FIG. 2 shows an arrangement of the voltage followers 35*a* and 35*b* and the analog switch 36. A voltage (common voltage) of the common electrode line should be constant in the source reversal mode. Therefore, in the case of using a voltage follower compatible with both positive and negative polarities., the analog video signal voltage ranges of +V/2 and −V/2 are generated on the positive and negative polarity sides, respectively, thereby increasing power consumption by bias current of the voltage follower. In the present embodiment, it is assumed that a power voltage range of the positive polarity voltage follower 35*a* is set between V/2 and V, which is the high voltage side half of a power voltage range of the positive/negative polarity compatible voltage follower, while a power voltage range of the negative polarity voltage follower 35*b* is set between GND and V/2, which is the low voltage side half of the power voltage range of the positive/negative polarity-compatible voltage follower, thereby reducing power consumption by the bias current of each voltage follower.

The analog switch 36 functions as a switching circuit which switches paths so that an analog video signal having the positive polarity from the voltage follower 35*a* and an analog video signal having the negative polarity from the voltage follower 35*b* are outputted in parallel in order of the corresponding data signal line SLi, namely, in order that the analog video signals of the positive and negative polarities are respectively outputted to the pixel k and k+1 to be displayed. The analog switch 36 includes n-channel MOSFETs 36*a*, 36*c*, 36*e* and 36*g* and p-channel MOSFETs 36*b*, 36*d*, 36*f* and 36*h*.

The drain of the n-channel MOSFET 36*a* and the source of the p-channel MOSFET 36*b* are connected to each other, and a point of connection thereof is connected to the output terminal of the voltage follower 35*a*. The source of the n-channel MOSFET 36*a* and the drain of the p-channel MOSFET 36*b* are connected to each other, and a point of connection thereof is an output terminal with respect to the odd-numbered pixel k.

The drain of the n-channel MOSFET 36*c* and the source of the p-channel MOSFET 36*d* are connected to each other, and a point of connection thereof is connected to the output terminal of the voltage follower 35*a*. The source of the n-channel MOSFET 36*c* and the drain of the p-channel MOSFET 36*d* are connected to each other, and a point of connection is an output terminal with respect to the even-numbered pixel k+1.

The drain of the n-channel MOSFET 36*e* and the source of the p-channel MOSFET 36*f* are connected to each other, and a point of connection thereof is connected to the output terminal of the voltage follower 35*b*. The source of the n-channel MOSFET 36*e* and the drain of the p-channel MOSFET 36*f* are connected to each other, and a point of connection is an output terminal with respect to the odd-numbered pixel k.

The drain of the n-channel MOSFET 36*g* and the source of the p-channel MOSFET 36*h* are connected to each other, and a point of connection is connected to the output terminal of the voltage follower 35*b*. The source of the n-channel MOSFET 36*g* and the drain of the p-channel MOSFET 36*h* are connected to each other, and a point of connection is an output terminal with respect to the even-numbered pixel k+1.

Further, it is set that an ON/OFF signal ϕ is applied to each gate of the n-channel MOSFETS 36*a* and 36*g* and the p-channel MOSFETs 36*d* and 36*f*. Likewise, an ON/OFF signal/ϕ (ϕ bar) whose polarity is opposed to that of the ON/OFF signal ϕ is applied to each gate of the n-channel MOSFETs 36*c* and 36*e* and the p-channel MOSFETs 36*b* and 36*h*.

In the voltage followers 35*a* and 35*b* and the analog switch 36 according to the foregoing arrangement, in the case (a) where an analog video signal of a subpixel pertaining to the odd-numbered pixel k is outputted from the voltage follower 35*a*, and an analog video signal of a subpixel pertaining to the even-numbered pixel k+1 is outputted from the voltage follower 35*b*, the ON/OFF signal ϕ becomes a positive voltage of not less than a threshold value of the n-channel MOSFET, and the ON/OFF signal/ϕ becomes a negative voltage of not more than a threshold value of the p-channel MOSFET, thereby turning ON the n-channel MOSFET 36*a*, the p-channel MOSFET 36*b*, the n-channel MOSFET 36*g* and the p-channel MOSFET 36*h* while turning OFF the n-channel MOSFET 36*c*, the p-channel MOSFET 36*d*, the n-channel MOSFET 36*e* and the p-channel MOSFET 36*f*. This causes an analog video signal from the voltage follower 35*a* to be outputted to an output terminal of the analog switch 36 toward the pixel k, and an analog video signal from the voltage follower 35*b* to be outputted to an output terminal of the analog switch 36 toward the pixel k+1.

Further, in the case (b) where the voltage follower 35*a* outputs an analog video signal of a subpixel pertaining to the even-numbered pixel k+1, and the voltage follower 35*b* outputs an analog video signal of a subpixel pertaining to the odd-numbered pixel k, the polarities of the ON/OFF signals ϕ and /ϕ are opposite from the foregoing case (a), thereby turning ON the n-channel MOSFET 36*c*, the p-channel MOSFET 36*d*, the n-channel MOSFET 36*e* and the p-channel MOSFET 36*f*, while turning OFF the n-channel MOSFET 36*a*, the p-channel MOSFET 36*b*, the n-channel MOSFET 36*g* and the p-channel MOSFET 36*h*. This causes an analog video signal from the voltage follower 35*a* to be outputted to the output terminal of the analog switch 36 toward the pixel k+1, and an analog video signal from the voltage follower 35*b* to be outputted to the output terminal of the analog switch 36 toward the pixel k.

Further, as shown in FIG. 1, demultiplexers 6*k* and 6*k*+1 are provided between the unit block 3(k,k+1) and the corresponding data signal lines SLi. An input terminal of the demultiplexer 6*k* is connected to the output terminal of the analog switch 36 toward the pixel k. When a signal RGB CNTL is a signal to discriminate R, G and B from one another, and analog video signals Rk', Gk' and Bk' are obtained from the digital video signals Rk, Gk and Bk through D/A conversion, the demultiplexer 6*k* selects an output terminal for display, based on the signal RGB CNTL, from three output terminals toward each data signal line SLi which is connected to the subpixel of the analog video signal Rk', Gk' or Bk', thereby switching connection paths between the input terminal (the output terminal toward the pixel k) and each data signal line SLi.

The input terminal of the demultiplexer 6*k*+1 is connected to the output terminal of the analog switch 36 toward the pixel k+1. When analog video signals Rk+1', Gk+1' and Bk+1' are obtained from the digital video signals Rk+1, Gk+1' and Bk+1 through D/A conversion, the demultiplexer 6*k*+1 selects an output terminal for display, based on the signal RGB CNTL, from the three output terminals toward each data signal line SLi which is connected to the subpixel of the analog video signal Rk+1', Gk+1' or Bk+1', thereby switching connection paths between the input terminal (the output terminal toward the pixel k+1) and each data signal line SLi. This causes each output signal of the data signal line driving circuit 3 to be outputted to the corresponding data signal line SLi.

With regard to the conditions of the selectors 31*a* and 31*b*, the switches 32*a* and 32*b*, the analog switch 36 and the demultiplexers 6*k* and 6*k*+1 in 1 horizontal scanning period in the foregoing liquid crystal display device 1, Table 1 and Table 2 below will show an example condition in the case of odd-number field and an example condition in the case of even-number field, respectively.

TABLE 1

| | | 0 H-1/3 H | | 1/3 H-2/3 H | | 2/3 H-1 H | |
|---|---|---|---|---|---|---|---|
| SEL31a | SEL31b | Rk | Rk + 1 | Gk + 1 | Gk | Bk | Bk + 1 |
| SW | | NOT REVERSED* | | NOT REVERSED | | NOT REVERSED | |
| ASW | | NOT REVERSED | | REVERSED** | | NOT REVERSED | |
| DMUX 6k | DMUX 6k + 1 | Rk' LINE | Rk + 1' LINE | Gk' LINE | Gk + 1' LINE | Bk' LINE | Bk + 1' LINE |

TABLE 1-continued

| | 0 H-1/3 H | 1/3 H-2/3 H | 2/3 H-1 H |
|---|---|---|---|

N.B. *"NOT REVERSED" denotes that the adjacent sets of RGB subpixels are not reversed.
***"REVERSED" denotes that the adjacent sets of RGB subpixels are reversed.

TABLE 2

| | | 0 H-1/3 H | | 1/3 H-2/3 H | | 2/3 H-1 H | |
|---|---|---|---|---|---|---|---|
| SEL31a | SEL31b | Rk | Rk + 1 | Gk + 1 | Gk | Bk | Bk + 1 |
| SW | | REVERSED** | | REVERSED | | REVERSED | |
| ASW | | REVERSED | | NOT REVERSED* | | REVERSED | |
| DMUX 6k | DMUX 6k + 1 | Rk' LINE | Rk + 1' LINE | Gk' LINE | Gk + 1' LINE | Bk' LINE | Bk + 1' LINE |

N.B. *"NOT REVERSED" denotes that the adjacent sets of RGB subpixels are not reversed.
***"REVERSED" denotes that the adjacent sets of RGB subpixels are reversed.

Note that, in Tables 1 and 2 above, "SEL" denotes the selector, "SW" denotes the switch (a combination of 32*a* and 32*b*), "ASW" denotes the analog switch (36 in its entirety), "IDMUX" denotes the demultiplexer, and "HI" denotes the horizontal scanning period. Further, the row of "SEL" indicates digital video signals which are respectively selected by the selectors 31*a* and 31*b* from the group of digital video signals Rk, Gk, Bk, Rk+1, Gk+1 and Bk+1. The row of "DMUX" indicates a path toward the data signal line SLi after switching, which is selected from the group of analog video signals Rk', Gk', Bk', Rk+1', Gk+1' and Bk+1'. After 1H, the same conditions of OH onward are repeated.

Further, as to the flow of an analog video signal in one horizontal scanning period, Table 3 and Table 4 below will show an example condition in the case of an odd-number field and an example condition in the case of an even-number field, respectively.

TABLE 3

| | 0 H-1/3 H | 1/3 H-2/3 H | 2/3 H-1 H |
|---|---|---|---|
| + VOLTAGE FOLLOWER INPUT | Rk' | Gk + 1' | Bk' |
| − VOLTAGE FOLLOWER INPUT | Rk + 1' | Gk' | Bk + 1' |
| ODD-NUMBER OUTPUT LINE | + VOLTAGE FOLLOWER OUTPUT | − VOLTAGE FOLLOWER OUTPUT | + VOLTAGE FOLLOWER OUTPUT |
| EVEN-NUMBER OUTPUT LINE | − VOLTAGE FOLLOWER OUTPUT | + VOLTAGE FOLLOWER OUTPUT | − VOLTAGE FOLLOWER OUTPUT |

TABLE 4

| | 0 H-1/3 H | 1/3 H-2/3 H | 2/3 H-1 H |
|---|---|---|---|
| + VOLTAGE FOLLOWER INPUT | Rk + 1' | Gk' | Bk + 1' |
| − VOLTAGE FOLLOWER INPUT | Rk' | Gk + 1' | Bk' |
| ODD-NUMBER OUTPUT LINE | − VOLTAGE FOLLOWER OUTPUT | + VOLTAGE FOLLOWER OUTPUT | − VOLTAGE FOLLOWER OUTPUT |
| EVEN-NUMBER OUTPUT LINE | + VOLTAGE FOLLOWER OUTPUT | − VOLTAGE FOLLOWER OUTPUT | + VOLTAGE FOLLOWER OUTPUT |

In Tables 3 and 4 above, the rows of "+VOLTAGE FOLLOWER INPUT" and "−VOLTAGE FOLLOWER INPUT" respectively indicate the states of variation of the analog video signals, one of which is inputted to the positive polarity voltage follower 35*a* and the other to the negative polarity voltage follower 35*b*. The variation is observed for each one third of a horizontal scanning period. Further, the rows of "ODD-NUMBER OUTPUT LINE" and "EVEN-NUMBER OUTPUT LINE" respectively indicate the states of variation of the polarity of an analog video signal to be outputted to the odd-numbered pixel k or the even-numbered pixel k+1 shown in FIG. 2. The variation is observed for each one third of a horizontal scanning period.

As discussed, the data signal line driving circuit 3 according to the present embodiment is provided with the level shifters of stages after the hold memory, the D/A converters and the voltage followers that can respectively be classified into two different systems, one of which is for the positive polarity only and the other is for the negative polarity only, and the former forms the positive polarity system, and the latter forms the negative polarity system. Throughout the whole data signal line driving circuit 3, the positive polarity system and the negative polarity system are disposed alternately. Further, one each of the positive polarity system and the negative polarity system respectively are set to serve as the single video signal processors performing processing of the inputted digital video signals, and the total number of the video signal processors are adjusted to the same as the number of sets of subpixels in the direction of the scanning signal line GLj. For example, there are 640 video signal processors in the case of VGA and 800 in the case of SVGA.

Further, there are provided selection circuits (the selectors 31*a* and 31*b* and the switches 32*a* and 32*b*) and a switch circuit (the analog switch 36), the selection circuits dividing the digital video signals Rk, Gk, Bk, Rk+1, Gk+1 and Bk+1 for input into two different combinations, one of which is a combination of the digital video signals Rk, Bk and Gk+1 and the other is a combination of the digital video signals Gk, Rk+1 and Bk+1, and selectively inputting them to the positive and negative polarity systems in one scanning period so as to satisfy such a polarity relation that the polarity of a voltage with respect to a predetermined voltage of the adjacent data signal lines SLi is reversed and the polarity of the voltage of the single data signal line SLi is reversed by a predetermined period, and the switch circuit switching paths so that output signals of the respective voltage followers are outputted in parallel in order of the corresponding data signal lines SLi.

With this arrangement, in comparison with the case where one video signal processor is provided for each data signal line SLi, the total number of the video signal processors in the present embodiment decreases to one third. Furthermore, it is set that a range of the power voltage of the positive polarity voltage follower 35*a* is the high voltage side half of the range of the power voltage of the positive/negative polarity-compatible voltage follower, and a range of the power voltage of the negative polarity voltage follower 35*b* is the low voltage side half of the range of the power voltage of the positive/negative polarity-compatible voltage follower. Consequently, it is possible to reduce the sum total of bias currents in the voltage followers while making good use of the characteristic of the source reversal mode such that a charge quantity with respect to a liquid crystal becomes small, thereby reducing consumed power.

As discussed, the data signal line driving circuit capable of low power consumption while having the voltage followers can be provided. In addition, since the number of video signal processors decreases in that case, it is possible to drive an image display device, such as a liquid crystal display device having a data signal line SLi of a dot pitch which is one third of the conventional limit value of the dot pitch, thereby realizing a high-resolution image display device.

Moreover, the foregoing applies not only in the case where one each of the positive polarity system and the negative polarity system are provided with respect to the data signal lines SLi for two pixels in the direction of the scanning signal line GLj as with the present embodiment but also in the case where, when a set of data signal lines SLi consists of a predetermined number of consecutive data signal lines SLi, such as three or more lines, each set of the data signal lines SLi is provided with both the positive polarity system and the negative polarity system. In that case, the selection circuit is set to divide the digital video signals of each set for input and selectively input them to the positive and negative polarity systems, respectively, in one scanning period so as to satisfy the polarity relation. This arrangement enables processing of all the digital video signals for input while allowing the voltage followers to be provided so that the total number of the voltage followers for a set of data signal lines is smaller than the total number of the set of data signal lines. Therefore, compared with the case where all data signal lines are provided with the voltage followers, the total number of the voltage followers is reduced. This, together with the suppression of bias currents of the respective voltage followers, causes large reduction of power consumption. Likewise, since the number of the video signal processors is reduced, it is possible to drive an image display device having a data signal line of a dot pitch which is smaller than a conventional limit value of the dot pitch.

Further, as with the present embodiment, an arrangement in which both the positive polarity system and the negative polarity system are provided with respect to each set of an even number of the consecutive data signal lines SLi consisting of not less than four lines enables, as shown in Tables 3 and 4, the simultaneous use of the both positive and negative polarity systems. Accordingly, when either one of the systems is in use, the other is free from standby power consumption, thereby greatly reducing power consumption.

Furthermore, as with the present embodiment, it is arranged that, when each set of the data signal lines SLi consists of the data signal lines SLi for two pixels, where one pixel is made up of three subpixels R, G and B which are adjacently disposed in the direction of the scanning signal line GLj, then both the positive polarity system and the negative polarity system are provided with respect to each set of the data signal lines SLi. With this arrangement, the operation of selective input by the selection circuits and the operation of switch by the switch circuit can readily be performed in the color of R, G or B, while making it possible to attain a data signal line driving circuit with the enhanced general versatility, which can be mounted in a common color image display device.

Further, the liquid crystal display device 1 according to the present embodiment is provided with the foregoing data signal line driving circuit 3, and the demultiplexers 6*k* and 6*k*+1 which switch connection paths between the output terminal of the switch circuit and the data signal line SLi so that the output signal of the data signal line driving circuit 3 can be outputted to the corresponding data signal line SLi. An image is displayed by thus outputting the output signal of the data signal line driving circuit 3 to the corresponding data signal line SLi by the demultiplexers 6*k* and 6*k*+1. Therefore, in the case where, as with the present embodiment, analog video signals are chronologically divided and outputted from the switch circuit in one scanning period, the analog video signals can be distributed to the corresponding data signal lines SLi with ease, while making it possible to provide an image display device capable of low power consumption. Note that, the demultiplexers 6*k* and 6*k*+1 may be part of the data signal line driving circuit 3.

Further, there has been explained AC driving according to the source reversal mode in the above. However, naturally, the arrangements of the present invention are also applicable to AC driving according to the dot reversal mode.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A data signal line driving circuit which outputs an analog video signal to each of data signal lines of an image display device having scanning signal lines and the data signal lines via a voltage follower according to such a polarity relation that a polarity of a voltage with respect to a predetermined voltage of the adjacent data signal lines is reversed while reversing the polarity of the voltage of the single data signal line by a predetermined period, the analog video signal being obtained from an inputted digital video signal through D/A conversion, the data signal line driving circuit comprising:

a positive polarity system including a positive polarity D/A converter and a positive polarity voltage follower in the case of said polarity of the voltage, and a negative polarity system including a negative polarity D/A converter and a negative polarity voltage follower;

selection circuits; and a switch circuit, wherein:

both said positive polarity system and said negative polarity system are provided with respect to each set of said data signal lines consisting of a predetermined number of the consecutive data signal lines which are not less than three data signal lines, a range of a power voltage of said positive polarity voltage follower is a high voltage side half of a range of a power voltage of a positive/negative polarity-compatible voltage follower, and a range of a power voltage of said negative polarity voltage follower is a low voltage side half of the range of the power voltage of the positive/negative polarity-compatible voltage follower, said selection circuits each divide and selectively input said each digital video signal to said positive polarity system or negative polarity system in one scanning period so as to satisfy said polarity relation, and said switch circuit switches paths so that respective output signals of said voltage followers are outputted in parallel in order of said corresponding data signal lines.

2. The data signal line driving circuit set forth in claim 1, wherein:

both said positive polarity system and said negative polarity system are provided with respect to each set of a predetermined even number of said consecutive data signal lines.

3. The data signal line driving circuit set forth in claim 2, wherein:

both said positive polarity system and said negative polarity system are provided with respect to each set of said data signal lines for two pixels, where each pixel is made up of three subpixels R, G and B which are adjacently disposed in a direction of said scanning signal line.

4. The data signal line driving circuit set forth in claim 3, wherein:

said scanning period is divided into three, which are a first scanning period provided in association with the subpixel R, a second scanning period provided in association with the subpixel G, and a third scanning period provided in association with the subpixel B, and said switch circuit for each of said data signal lines outputs an output signal to the subpixel R in said first scanning period, to the subpixel G in said second scanning period, and to the subpixel B in said third scanning period.

5. An image display device, comprising:

a data signal line driving circuit which outputs an analog video signal to each of data signal lines of the image display device having scanning signal lines and the data signal lines via a voltage follower according to such a polarity relation that a polarity of a voltage with respect to a predetermined voltage of the adjacent data signal lines is reversed while reversing the polarity of the voltage of the single data signal line by a predetermined period, the analog video signal being obtained from an inputted digital video signal through D/A conversion, comprising:

a positive polarity system including a positive polarity D/A converter and a positive polarity voltage follower in the case of said polarity of the voltage, and a negative polarity system including a negative polarity D/A converter and a negative polarity voltage follower;

selection circuits;

a switch circuit; and demultiplexers which switch connection paths between an output terminal of said switch circuit and said data signal line so that an output signal of said data signal line driving circuit is outputted to the corresponding data signal line, wherein:

both said positive polarity system and said negative polarity system are provided with respect to each set of said data signal lines consisting of a predetermined number of the consecutive data signal lines which are not less than three data signal lines;

a range of a power voltage of said positive polarity voltage follower is a high voltage side half of a range of a power voltage of a positive/negative polarity-compatible voltage follower, and a range of a power voltage of said negative polarity voltage follower is a low voltage side half of the range of the power voltage of the positive/negative polarity-compatible voltage follower;

said selection circuits each divide and selectively input said each digital video signal to said positive polarity system or negative polarity system in one scanning period so as to satisfy said polarity relation; and said switch circuit switches paths so that respective output signals of said voltage followers arc outputted in parallel in order of said corresponding data signal lines.

6. An image display device, comprising:

a data signal line driving circuit which outputs an analog video signal to each of data signal lines of the image display device having scanning signal lines and the data signal lines via a voltage follower according to such a polarity relation that a polarity of a voltage with respect to a predetermined voltage of the adjacent data signal lines is reversed while reversing the polarity of the voltage of the single data signal line by a predetermined period, the analog video signal being obtained from an inputted digital video signal through D/A conversion, comprising:

a positive polarity system including a positive polarity D/A converter and a positive polarity voltage follower in the case of said polarity of the voltage, and a negative polarity system including a negative polarity D/A converter and a negative polarity voltage follower;

selection circuits;

a switch circuit; and demultiplexers which switch connection paths so that each output terminal of said switch circuit is connected to the data signal line toward the subpixel R in said first scanning period, said output terminal is connected to the data signal line toward the subpixel G in said second scanning period, and said output terminal is connected to the data signal line toward the subpixel B in said third scanning period, wherein:

both said positive polarity system and said negative polarity system are provided with respect to each set of said data signal lines consisting of a predetermined number of the consecutive data signal lines which arc not less than three data signal lines;

a range of a power voltage of said positive polarity voltage follower is a high voltage side half of a range of a power voltage of a positive/negative polarity-compatible voltage follower, and a range of a power voltage of said negative polarity voltage follower is a low voltage side half of the range of the power voltage of the positive/negative polarity-compatible voltage follower;

said selection circuits each divide and selectively input said each digital video signal to said positive polarity system or negative polarity system in one scanning period so as to satisfy said polarity relation;

said switch circuit switches paths so that respective output signals of said voltage followers arc outputted in parallel in order of said corresponding data signal lines.

both said positive polarity system and said negative polarity system are provided with respect to each set of a predetermined even number of said consecutive data signal lines;

both said positive polarity system and said negative polarity system are provided with respect to each set of said data signal lines for two pixels, where each pixel is made up of three subpixels R, G and B which arc adjacently disposed in a direction of said scanning signal line;

said scanning period is divided into three, which are a first scanning period provided in association with the subpixel R, a second scanning period provided in association with the subpixel G, and a third scanning period provided in association with the subpixel B; and said switch circuit for each of said data signal lines outputs an output signal to the subpixel R in said first scanning period, to the subpixel G in said second scanning period, and to the subpixel B in said third scanning period.

* * * * *